United States Patent [19]

Kemmler

[11] Patent Number: 4,694,578

[45] Date of Patent: Sep. 22, 1987

[54] MOTOR-DRIVEN CHAIN SAW

[75] Inventor: Ralf-Rainer Kemmler, Grossbottwar, Fed. Rep. of Germany

[73] Assignee: Andreas Stihl, Waiblingen, Fed. Rep. of Germany

[21] Appl. No.: 886,905

[22] Filed: Jul. 16, 1986

[30] Foreign Application Priority Data

Jul. 18, 1985 [DE] Fed. Rep. of Germany ..... 3525593

[51] Int. Cl.[4] ..... B27B 17/00

[52] U.S. Cl. ..... 30/383; 123/2; 123/195 R

[58] Field of Search ..... 30/381–387; 123/2, 195 R, 195 H, 195 P

[56] References Cited

U.S. PATENT DOCUMENTS 4,382,333 5/1983 Nagashima et al. ..... 30/381
4,411,071 10/1983 Takehashi et al. ..... 30/381
4,584,928 4/1986 Haynes ..... 123/195 R X

FOREIGN PATENT DOCUMENTS 8301035 3/1983 World Int. Prop. O. ..... 30/383

*Primary Examiner*—E. R. Kazenske
*Assistant Examiner*—Michael D. Folkerts
*Attorney, Agent, or Firm*—Walter Ottesen

[57] ABSTRACT

A motor-driven chain saw essentially includes a housing having a rear handle and a front handle and a drive unit attached to the housing. A guide bar for accommodating the saw chain for movement thereon is attached to the drive unit. The housing has an extension arm on the underside of the chain saw which extends to the front; the drive unit is seated on this arm and the front handle is attached to the front end of the arm. To increase torsional and bending strength, the extension arm has an S-shaped profile when viewed in cross section. The S-shaped profile has a substantially rectangular configuration and includes lower, middle and upper parts that are parallel to one another and are interconnected by two flanks. The flanks are located in planes that are parallel to the guide bar.

9 Claims, 11 Drawing Figures

34
10
16
33
32
11
12
13
9
17
18
1
21
2
5
34
V
10
V
II A
33
16
24
(19.20)
14
6
7
IV
4
3
32
4

1
9
10
24
25
26
27
28
29
30
31
32
34
V
VI

MOTOR-DRIVEN CHAIN SAW

FIELD OF THE INVENTION

The invention relates to a motor-driven chain saw having a housing and front and back handles. The housing has an extension arm near its underside that points forward and is configured as a profile section. A drive unit is mounted on the extension arm which supports a guide bar with a saw chain mounted for movement on the latter. One end of the front handle is secured near the end of the extension arm.

BACKGROUND OF THE INVENTION

Motor-driven chain saws essentially include three parts: a housing, a drive unit, and a forwardly directed guide bar for accommodating the moving saw chain thereon. The guide bar is secured to the drive unit while the drive unit itself is mounted on an extension arm of the housing with which it is connected via vibration dampers. The housing has a rear handle, extending in the longitudinal direction of the guide bar, and a front handle extending crosswise to the rear handle and secured near the underside of the housing. For reasons of stability, one end of the front handle is secured near the front end of the chain saw on the extension arm, while the other end is secured farther back on the housing on the saw chain side thereof. This arrangement assures that all the handle parts are secured to the housing and is intended to prevent transmission of the inherent vibrations of the drive unit to the handles.

With this arrangement of the housing and drive unit, the extension arm on which the drive unit and one end of the front handle are secured has to take up strong bending and torsional forces during operation, because the transmission of force between the guide bar or drive unit and the handles is effected via the housing, and in particular via the extension arm. For this reason, in known motor-driven chain saws the extension arm is configured as a double-T-shaped profile section. With lightweight metal housings, this embodiment has proved to be strong enough; this is not the case, however, with housings made of plastic, such as polyamide, where under extreme loads permanent deformation of the extension arm occurs.

Since the housings are manufactured from cast parts, it is impossible, for manufacturing reasons, to provide a closed profile section, for instance a box section, although this would be desirable for reasons of strength.

SUMMARY OF THE INVENTION

It is an object of the invention to provide a motor-driven chain saw of the above type wherein the extension arm of the housing has sufficient bending and torsional strength that plastic deformations do not occur, even under extreme loads. The housing should also be inexpensive and simple to manufacture.

According to a feature of the motor-driven chain saw of the invention, this object is attained by providing the extension arm with an S-shaped profile section.

An S-shaped profile for this arm affords the advantage of having a bending and torsional strength that is markedly higher than that of known extension arms and that corresponds to that of a box-like profile; yet in terms of manufacturing, it continues to be simple to manufacture the housing using lateral tool spindles. The increase in strength is so great that the wall thickness can be further reduced in comparison with that of known extension arms, which means an additional weigth reduction and additional saving of material.

BRIEF DESCRIPTION OF THE DRAWING

The invention will now be described with reference to the drawing wherein.

DESCRIPTION OF THE PREFERRED EMBODIMENTS OF THE INVENTION

Figure 1:
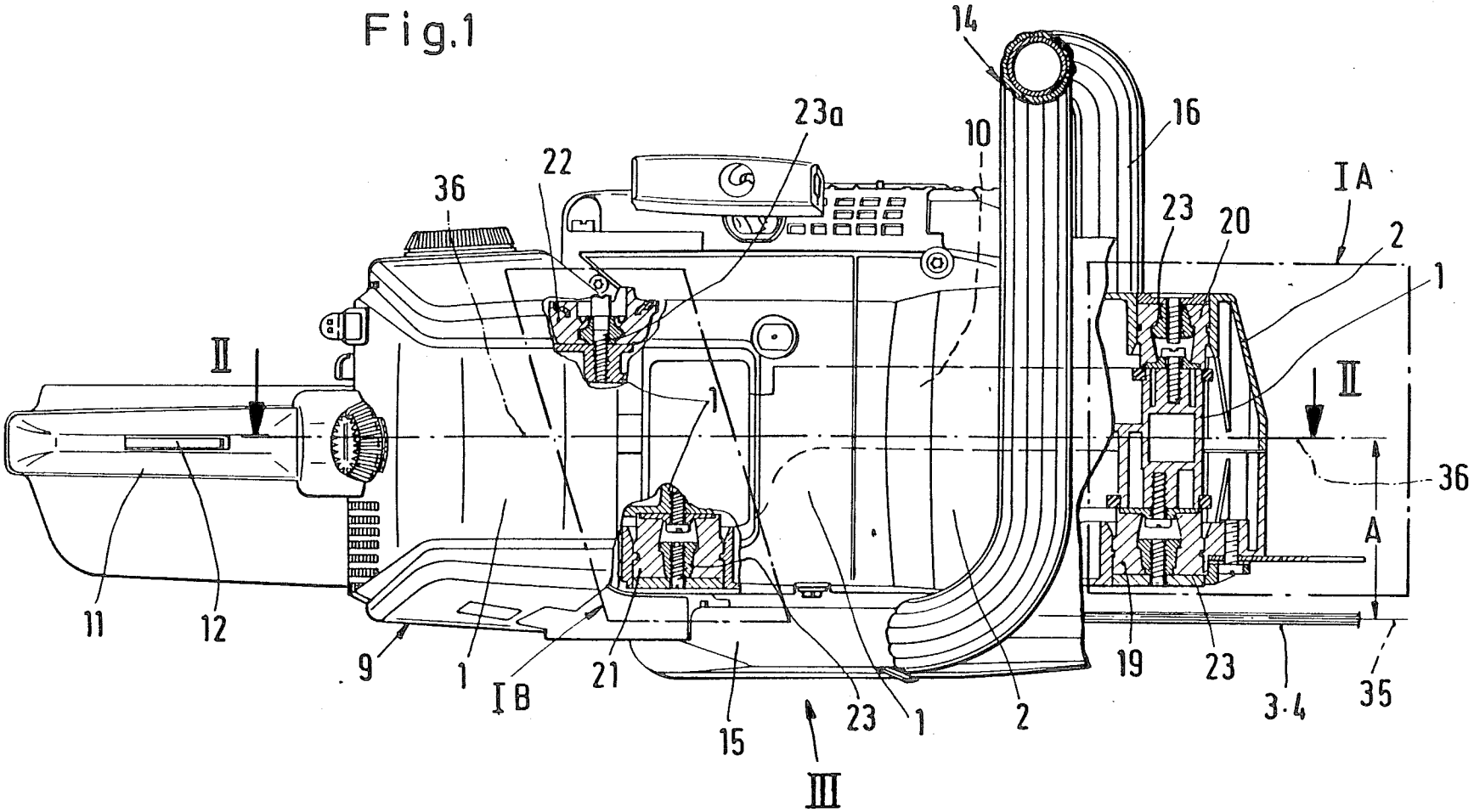
FIG. 1 is a plan view, shown partly in section, of a motor-driven chain saw according to the invention, showing only that part of the guide bar with the saw chain which is near to the housing.

The machine shown in the drawing is a motor-driven chain saw, which includes: a housing 1, a drive unit 2 attached to the housing 1 and a guide bar 3 which is fixedly mounted on the drive unit. The guide bar accomodates the saw chain 4.

Figures 2, 2A:
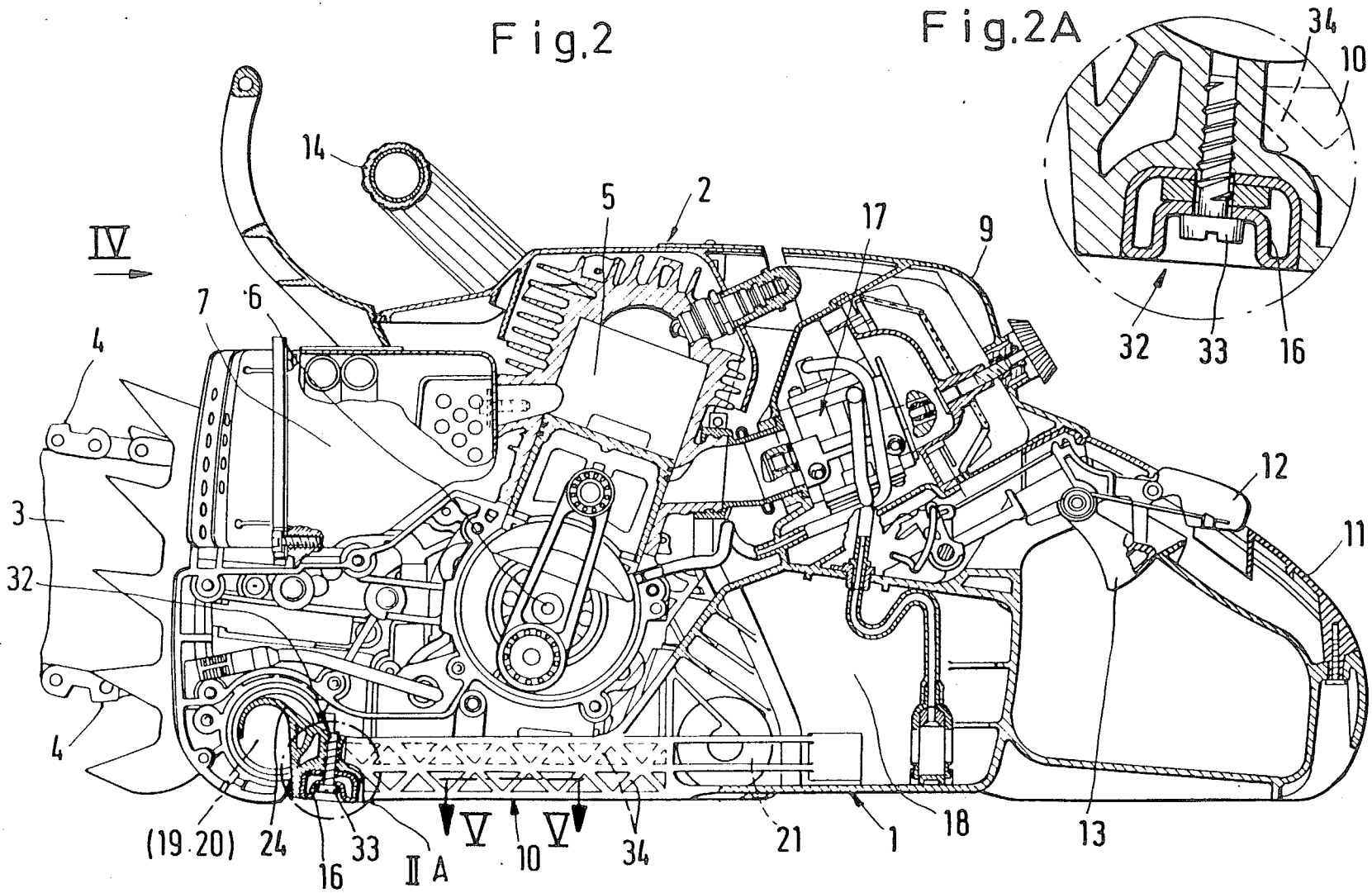
FIG. 2 is a section taken along the line II—II of FIG. 1.
FIG. 2A shows, on an enlarged scale, the attachment of the front handle of FIG. 2.

Here, as shown in FIG. 2, the drive unit includes an internal combustion engine 5 having a crankshaft 6 which drives a drive sprocket (not shown) via a centrifugal coupling (not shown). The drive sprocket drives the saw chain 4. As shown in FIG. 2, a muffler 7 is provided through which the exhaust gases are vented into the ambient at the front of the chain saw. The muffler 7 is mounted in the drive unit 2 ahead of the engine 5. The drive unit 2 shown here operates with an air-cooled two-stroke engine; however, other internal combustion engines or electric motors can also be used.

Near the outside of the chain saw seen on the right, as viewed from front to back in FIG, 3, the guide bar 3 is attached to the drive unit 2 by means of two screws 8. The drive unit 2 and guide bar 3 are mounted on the extension arm 10 of the housing 1 (FIG. 2). The extension arm 10 extends from a rear housing portion 9, which forms approximately the rear one-third of the chain saw, and extends forward, snug with the drive unit 2, almost to the front of the chain saw.

Figure 3:
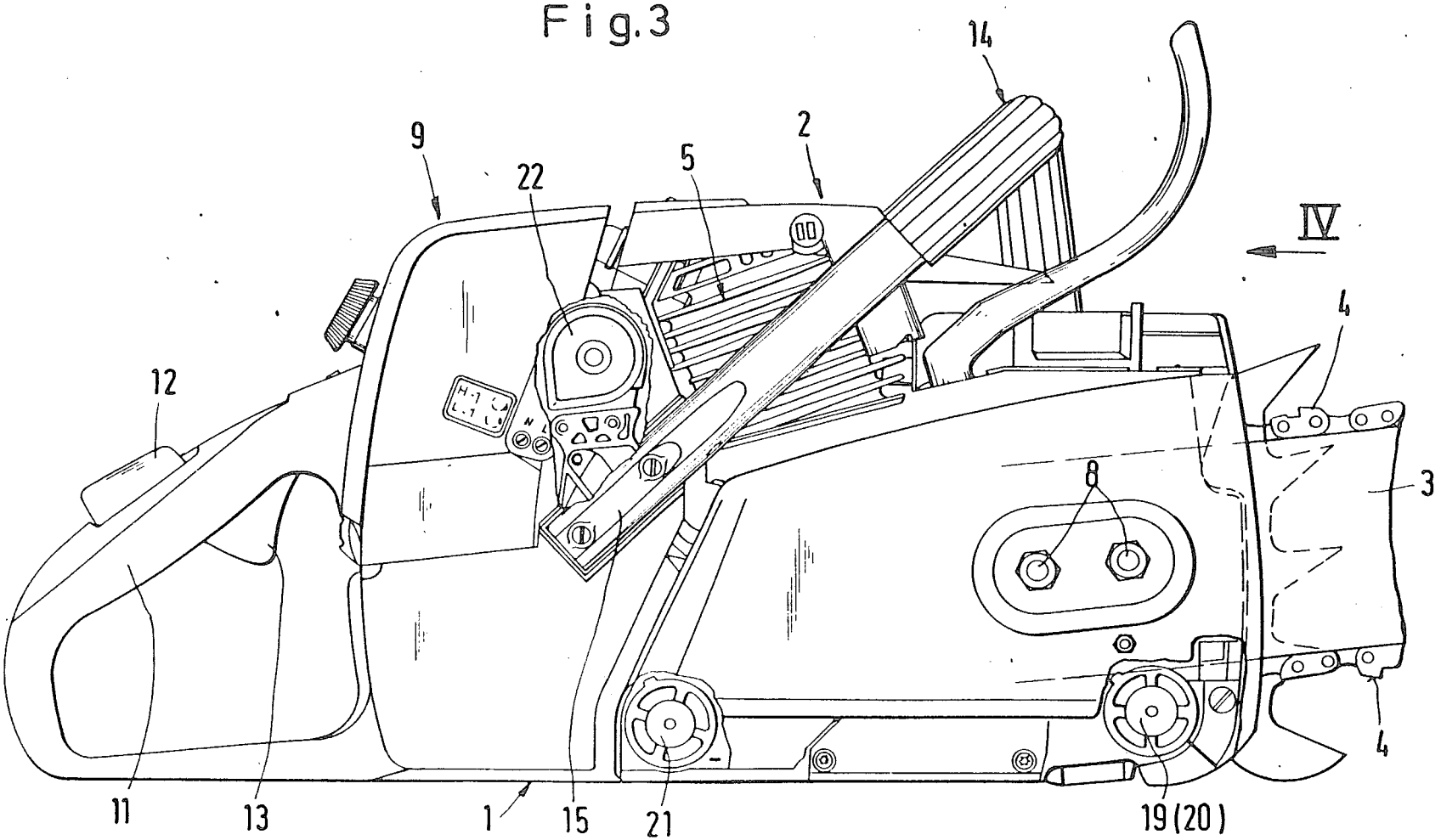
FIG. 3 is a side elevation view of the chain saw in the direction of the arrow III in FIG. 1 and is shown partly in section.

The housing 1 has a rear handle 11 which extends rearward from the rear of the housing 1 and is located approximately in the longitudinal central plane 36 of the chain saw, which extends parallel to and is spaced from the longitudinal central plane 35 of the guide bar 3 by a distance A (FIG. 1). A gas lever lock 12 and a gas lever 13 are integrated into a portion of the rear handle 11 as shown in FIG. 3. The front handle 14 extends in its handle region crosswise to the longitudinal central plane 36 of the chain saw and is spaced from the top and lefthand side of the housing. The handle 14 has a rear end 15, which is fixedly attached to the righthand outside surface of the housing 1 (FIG. 3). The front end 16 of the handle 14 is fixedly attached to the underside of the chain saw near the front end 24 of the extension arm 10 (FIG. 4).

In the rear housing portion 9, as shown in FIG. 2, in its lower portion between the rear handle 11 and the extension arm 10, a fuel tank 18 is provided, and the carburetor 17 of the engine 5 is disposed above the fuel tank.

Figure 1A:
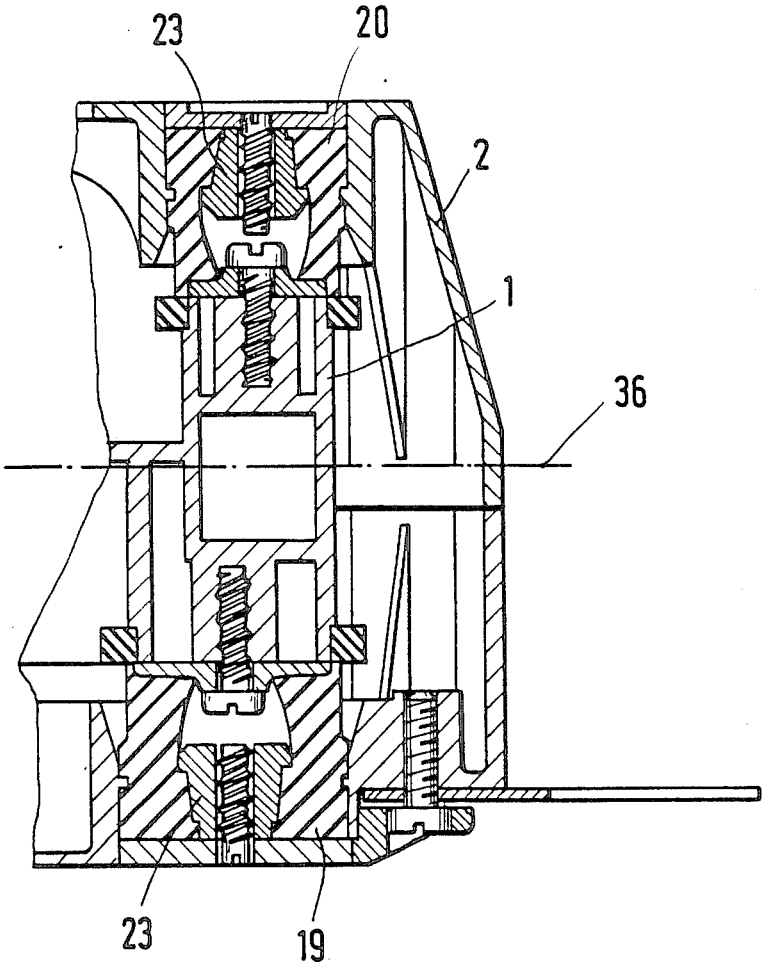
FIGS. 1A and 1B show details of FIG. 1 on a larger scale.
Figure 1B:
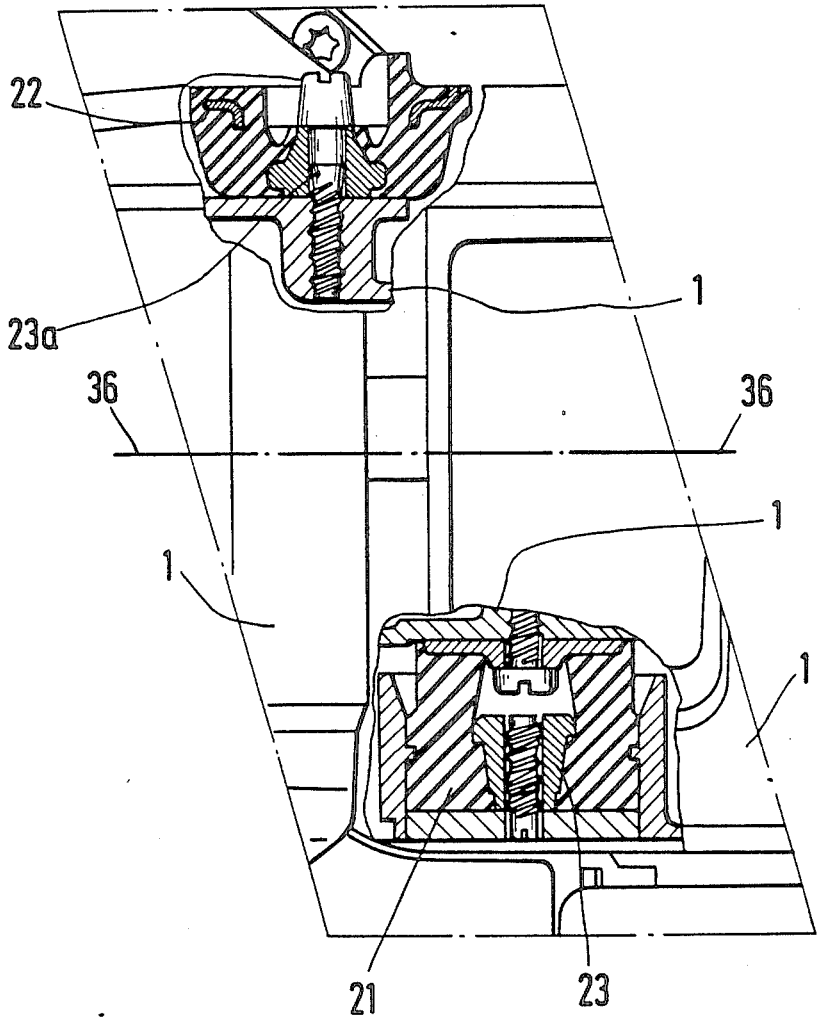

The drive unit 2 is braced toward the rear and from underneath by the housing 1 and is connected to the housing 1 via four antivibration elements 19 to 22. The antivibration elements 19 to 22, which are known per se, are rubber elastic sleeves of plastic or rubber, which are slipped over respective ones of spreader cones 23 or 23*a* to connect the housing 1 and the drive unit 2. The antivibration elements 19 to 22 are provided to damp vibration, and they support the drive unit 2 elastically on the housing 1. The front antivibration elements 19 and 20 (FIG. 1A) are tensionally secured to the front end 24 of the extension arm 10 and are disposed symmetrically with respect to the longitudinal central plane 36 of the chain saw. The two rear antivibration elements 21 and 22 (FIG. 1B) are secured on the rear housing portion 9; the element 21 at the right rear is disposed near the underside of the chain saw, approximately at the level of the handle end 15 (FIG. 3), while the antivibration element 22 is attached at the left rear and is located approximately at the level of the carburetor 17. Element 22 is disposed offset from and just behind the element 21 (shown in cutaway form in FIG. 3). The rear antivibration elements 21 and 22 are also spaced approximately equally from the longitudinal central plane 36 of the chain saw. The forces of reaction transmitted to the chain saw by the tool (that is, the guide bar 3 with the revolving saw chain 4) are initially transmitted to the drive unit 2 and are then introduced into the housing 1 via the antivibration elements 19 to 22. The housing 1 transmits these forces to the rear handle 11 and the front handle 14.

Figure 4:
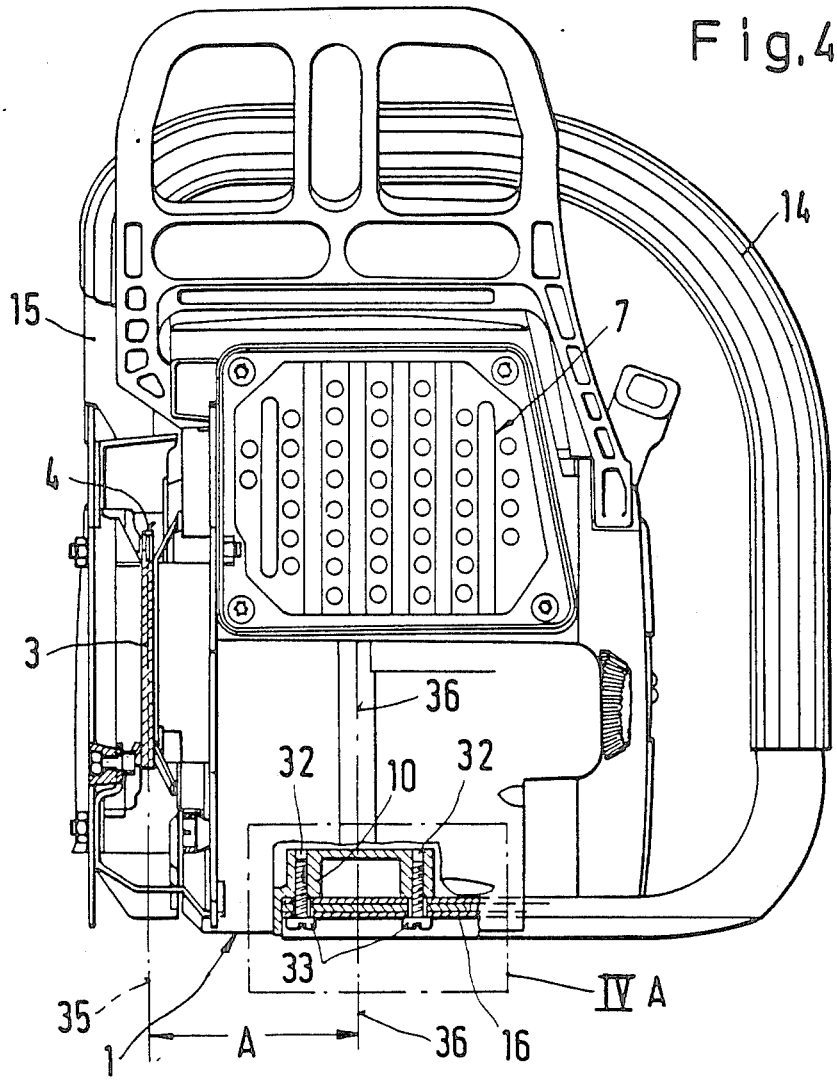
FIG. 4 is a front elevation view of the motor-driven chain saw of FIG. 1.

As FIGS. 2 and 4 show, the extension arm 10 is subject to particular strain in this construction: first, the extension arm 10 is relatively long and is not supported laterally by any other parts of the housing, so that it mush be configured to be inherently strong; and second, the end 16 of the front handle 14 is connected nearly the front end 24, which means that considerable forces must be transmitted. Furthermore, the housing 1 and in particular the extension arm 10 must bear the weight of the drive unit 2.

Figures 5, 6:
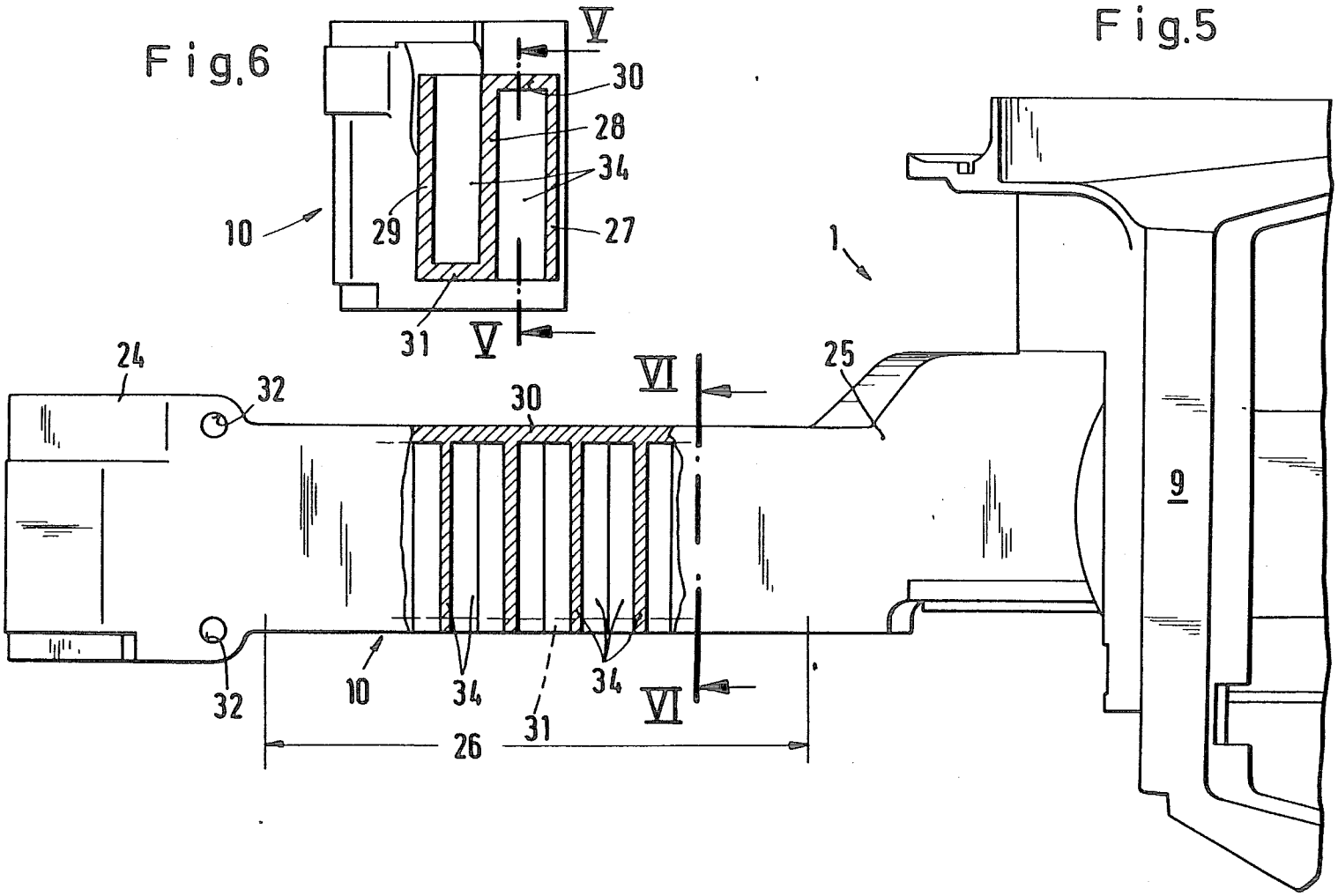
FIG. 5 is a plan view, on a larger scale, of the extension arm and part of the housing of the chain saw of FIG. 1.
FIG. 6 is a section taken along the line VI—VI in FIG. 5.
Figure 7:
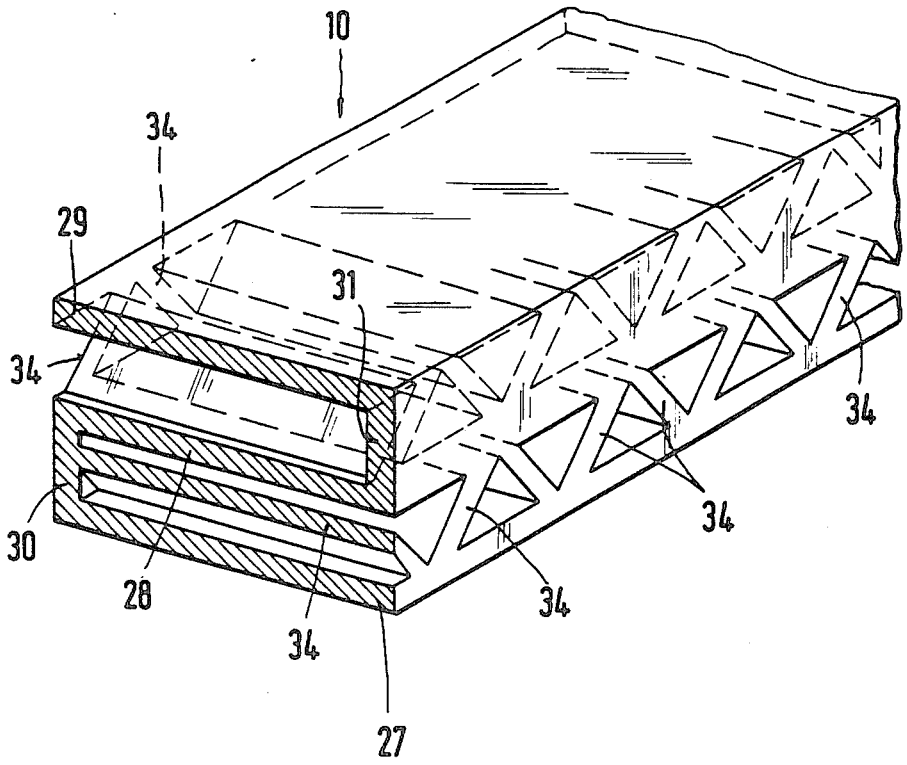
FIG. 7 is a perspective sectional view of a portion of the extension arm.

For these reasons, the extension arm 10 is configured to an S-shaped profile when viewed in section as shown in FIG. 6. The extension arm 10, shown in detail in FIG. 5, extends forward along a straight line from its end 25 near the housing where it is connected to the rear housing portion 9. The arm 10 extends forward up to its front end 24 near the front of the chain saw.

In the region identified by reference numeral 26 in FIG. 5, the extension arm 10 has a profile that is S-shaped in cross section, and as shown in FIG. 6, extends substantially rectangularly. The S-shaped profile essentially includes three parts 27 to 29 disposed parallel to one another and interconnected by the side flanks 30 and 31. The lower part 27 forms part of the chain saw base and, like the parts 28 and 29, is disposed at right angles to the longitudinal central plane 35 of the chain saw. Extending vertically upward from the lower part is the right flank 30, which joins the lower part 27 to the middle part 28. The upper part 29 is joined to the middle part 28 via the left flank 31, which is disposed parallel to both the flank 30 and the longitudinal central plane 36 of the chain saw. The same effect is attained if the arrangement has the S facing in the opposite direction, that is, if the left flank 31 joins the lower part 27 to the middle part 28, and the right flank 30 joins the upper part 29 to the middle part 28. The ratio of the width to the height of the profile cross section, in this embodiment, is approximately 4:3.

Figure 4A:
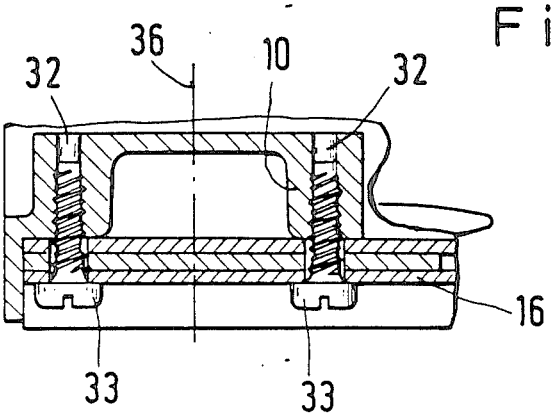
FIG. 4A shows, on a larger scale, the attachment of the front handle of FIG. 4.

To enable an optimal transmission of force into the extension arm 10, the front end 24 is configured to be somewhat wider in plan view (see FIG. 5) than the rest of the arm 10. As a result, the attachment locations 32, in this case bores 32, at which the front end 16 of the handle 14 is secured, can be disposed such that they are located in the respective planes of flanks 30 and 31 as shown in FIGS. 4 and 4A.

As a result of the S-shaped configuration of the extension arm 10 as described above, considerably greater bending and torsional strength is attained as compared with conventional arms. Since the transmission of force from the front end 16 of the handle 14 is effected substantially via the screws 33 (FIGS. 4, 4A), and an amplified tension-compression load is introduced into the extension arm 10 by this path, the disposition of the attachment locations 32 in the flanks 30 and 31 is particularly favorable, because as a result, force is introduced virtually directly into the flanks 30 and 31 and the parts 27 to 29 that are parallel to the base.

As shown in FIG. 2, the extension arm 10 is provided with further reinforcement in the form of reinforcing walls 34, which are inclined alternatingly in opposite directions by 45° with respect to the profile parts 27 to 29, in the manner of a truss framework, and which are disposed at right angles to the flanks 30 and 31. The ribs 34 extend over the entire width of the extension arm 10, extending respectively from the bottom part 27 of the profile to the middle part 28, of from the top part 29 to the middle part 28, and are firmly joined to the flanks 30 and 31, respectively. The ribbing increases not only the bending strength but particularly the torsional strength of the extension arm 10.

The extension arm described in the embodiment shown in FIGS. 1 to 6 is strong enough to absorb the reaction forces arising during operation and to transmit them to the handles; it can also be produced at low manufacturing cost, because the transverse profile can be produced using lateral tool spindles.

It is understood that the foregoing description is that of the preferred embodiments of the invention and that various changes and modifications may be made thereto without departing from the spirit and scope of the invention as defined in the appended claims.

What is claimed is:

1. A motor-driven chain saw comprising:

a housing having a front wall, a rear wall, two longitudinal side walls extending rearwardly from said front wall to said rear wall, and a base wall extending between said side walls;

a first handle on said rear wall of said housing for holding and operating the chain saw;

an elongated extension arm defining a longitudinal axis and being mounted on said housing in the region of said base wall so as to extend in the direction toward the front of said chain saw so as to be laterally unsupported by said housing, said extension arm having an S-shaped wall when viewed in cross section transverse to said longitudinal axis; said elongated arm having a top surface;

a saw chain;

a guide bar for accommodating said saw chain for movement thereon;

a drive unit for driving said saw chain, said drive unit being supported on said extension arm adjacent said top surface; and, an elongated second handle mounted forward of said rear handle and having one end attached to said extension arm.

2. A motor-driven chain saw comprising:

a housing having a front wall, a rear wall, two longitudinal side walls extending rearwardly from said front wall to said rear wall, and a base wall extending between said side walls;

a first handle on said rear wall of said housing for holding and operating the chain saw;

an elongated extension arm mounted on said housing in the region of said base wall so as to extend in the direction toward the front of said chain saw, said extension arm having a cross section defining an S-shaped profile;

a saw chain;

a guide bar for accommodating said saw chain for movement thereon;

a drive unit seated on said extension arm for driving said saw chain;

an elongated second handle mounted forward of said rear handle and having one end attached to said extension arm;

said guide bar defining a guide-bar plane; and, said extension arm including three mutually parallel rectangularly-shaped flat segments defining respective planes substantially perpendicular to said guide-bar plane, said flat segments being arranged one atop the other; and, said extension arm further including two side segments respectively interconnecting the top flat segment and the middle flat segment and said middle flat segment and the bottom flat segment in such a manner so as to define said S-shaped profile.

3. The motor-driven chain saw of claim 2, said side segments being rectangularly-shaped flat segments extending substantially parallel to said guide-bar plane.

4. The motor-driven chain saw of claim 3, said side segments defining respective side planes substantially parallel to said guide-bar plane, the chain saw further comprising two attachment means formed in said extension bar for attaching said one end of said second handle to said extension arm, said two attachment means being located in said extension arms so as to lie in corresponding ones of said side planes.

5. The motor-driven chain saw of claim 4, said extension arm including side walls at one end thereof which extend forwardly from corresponding ones of said side segments, said two attachment means being formed in respect ones of said side walls.

6. The motor-driven chain saw of claim 2, the extension arm including a first plurality of transverse ribs for interconnecting said top flat segment and said middle flat segment and a second plurality of transverse ribs for interconnecting said bottom flat segment and said middle flat segment thereby increasing the torsional strength of said extension arm.

7. A motor-driven chain saw comprising:

a housing having a front wall, a rear wall, two longitudinal side walls extending rearwardly from said front wall to said rear wall, and a base wall extending between said side walls;

a first handle on said rear wall of said housing for holding and operating the chain saw;

an elongated extension arm defining a longitudinal axis and being mounted on said housing in the region of said base wall so as to extend in the direction toward the front of said chain saw, said extension arm being configured to have an S-shaped wall when viewed in cross section transverse to said longitudinal axis;

said S-shaped wall defining a first recess extending parallel to said longitudinal axis and a second recess directly beneath said first recess and also extending parallel to said longitudinal axis;

reinforcement means arranged in said first recess and said second recess for imparting increased torsional strength to said arm;

a saw chain;

a guide bar for accommodating said saw chain for movement thereon;

a drive unit seated on said extension arm for driving said saw chain; and, an elongated second handle mounted forward of said rear handle and having one end attached to said extension arm.

8. A motor-driven chain saw comprising:

a housing having a front wall, a rear wall, two longitudinal side walls extending rearwardly from said front wall to said rear wall, and a base wall extending between said side walls;

a first handle on said rear wall of said housing for holding and operating the chain saw;

a saw chain;

a guide bar defining a guide-bar plane and being mounted on said housing for accommodating said saw chain for movement thereon;

an elongated extension arm defining a longitudinal axis and being mounted on said housing in the region of said base wall so as to extend in the direction toward the front of said chain saw, said extension arm having a top surface and including three mutually parallel rectangularly-shaped flat segments defining respective planes substantially perpendicular to said guide-bar plane, said flat segments being arranged one atop the other; and, said extension arm further including first and second segments respectively interconnecting the top flat segment and the middle flat segment and said middle flat segment and the bottom flat segment, said first and second segments being located on opposite sides of said longitudinal axis;

a drive unit for driving said saw chain, said drive unit being supported on said extension arm above said top surface for driving said saw chain; and, an elongated second handle mounted forward of said rear handle and having one end attached to said extension arm.

9. The motor-driven chain saw of claim 8, said flat segments and said first and second segments conjointly defining recess means extending parallel to said longitudinal axis; and, reinforcement means arranged in said recess means for imparting increased torsional strength to said arm.

* * * * *

UNITED STATES PATENT AND TRADEMARK OFFICE

CERTIFICATE OF CORRECTION

PATENT NO. : 4,694,578

DATED : September 22, 1987

INVENTOR(S) : Ralf-Rainer Kemmler

It is certified that error appears in the above-identified patent and that said Letters Patent is hereby corrected as shown below:

In column 2, line 52: delete "FIG, 3," and substitute -- FIG. 3, -- therefor.

In column 3, line 17: delete "rubber elastic" and substitute -- rubber-elastic -- therefor.

In column 3, line 48: delete "mush" and substitute -- must -- therefor.

In column 3, line 49: delete "nearly" and substitute -- near -- therefor.

In column 3, line 63: please delete "section, and" and substitute -- section and, -- therefor.

In column 4, line 1: please delete "35" and substitute -- 36 -- therefor.

In column 4, line 42: please delete "of" and substitute -- or -- therefor.

Signed and Sealed this

Fifteenth Day of March, 1988

*Attest:*

*Attesting Officer*

DONALD J. QUIGG

*Commissioner of Patents and Trademarks*